US008607877B2

(12) United States Patent
Rodrigues

(10) Patent No.: US 8,607,877 B2
(45) Date of Patent: Dec. 17, 2013

(54) PUMPING MODULE AND SYSTEM

(75) Inventor: Roberto Rodrigues, Rio de Janeiro (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 0 days.

(21) Appl. No.: 12/682,566

(22) PCT Filed: Oct. 10, 2008

(86) PCT No.: PCT/GB2008/003438
§ 371 (c)(1),
(2), (4) Date: Sep. 16, 2010

(87) PCT Pub. No.: WO2009/047521
PCT Pub. Date: Apr. 16, 2009

(65) Prior Publication Data

US 2011/0042093 A1 Feb. 24, 2011

(30) Foreign Application Priority Data

Oct. 10, 2007 (BR) ..... 0703726

(51) Int. Cl.
*E21B 43/01* (2006.01)

(52) U.S. Cl.
USPC ..... 166/344; 166/352; 166/357; 166/369; 166/68; 166/105.5; 417/54; 417/65

(58) Field of Classification Search
USPC ..... 166/344, 345, 347, 351, 352, 357, 366, 166/265, 369, 372, 54.1, 68, 105, 105.5; 417/54, 65
See application file for complete search history.

(56) References Cited

U.S. PATENT DOCUMENTS

| | | | | |
|---|---|---|---|---|
| 4,900,433 | A * | 2/1990 | Dean et al. | 210/170.11 |
| 5,698,014 | A * | 12/1997 | Cadle et al. | 96/157 |
| 6,062,313 | A * | 5/2000 | Moore | 166/357 |
| 6,230,810 | B1 * | 5/2001 | Rivas | 166/357 |
| 6,357,530 | B1 * | 3/2002 | Kennedy et al. | 166/369 |
| 6,497,287 | B1 * | 12/2002 | Podio et al. | 166/370 |
| 6,651,745 | B1 * | 11/2003 | Lush et al. | 166/357 |
| 6,688,392 | B2 * | 2/2004 | Shaw | 166/366 |
| 6,705,403 | B2 * | 3/2004 | Podio et al. | 166/370 |

(Continued)

FOREIGN PATENT DOCUMENTS

| | | |
|---|---|---|
| GB | 2 215 408 A | 9/1989 |
| GB | 2 226 776 A | 7/1990 |

(Continued)

*Primary Examiner* — Matthew Buck
(74) *Attorney, Agent, or Firm* — Sughrue Mion, PLLC

(57) ABSTRACT

This invention relates to equipment and a subsea pumping system using a subsea module installed on the sea bed, preferably away from a production well and intended to pump hydrocarbons having a high associated gas fraction produced by one or more subsea production wells to the surface. One object of this invention is achieved by means of the design of a pumping module (PM) which is linked to pumping equipment already present in a production well and which basically comprises: an inlet pipe (2), separator equipment (3), a first pump (4) and a second pump (8). In the subsea pumping system for the production of hydrocarbons with a high gas fraction, the other object of this invention, when oil is pumped from the production well (P) the well pump (13) increases the energy of the fluid in the form of pressure and transmits this increase in energy in the form of an increase in suction pressure in the second pump (8) of the subsea module (PM).

15 Claims, 4 Drawing Sheets

(56) References Cited

U.S. PATENT DOCUMENTS

| | | | | |
|---|---|---|---|---|
| 7,150,325 | B2 * | 12/2006 | Ireland et al. | 166/366 |
| 7,210,530 | B2 * | 5/2007 | Lush et al | 166/357 |
| 7,314,084 | B2 * | 1/2008 | Rodrigues et al. | 166/344 |
| 7,422,066 | B2 * | 9/2008 | Rodrigues et al. | 166/341 |
| 7,497,667 | B2 * | 3/2009 | Parr | 417/198 |
| 7,673,676 | B2 * | 3/2010 | Rivas et al. | 166/106 |
| 7,882,896 | B2 * | 2/2011 | Wilson et al. | 166/368 |
| 7,914,266 | B2 * | 3/2011 | Kerr et al. | 417/410.1 |
| 7,984,766 | B2 * | 7/2011 | Brown et al. | 166/372 |
| 2006/0045757 | A1 * | 3/2006 | Parr | 417/76 |
| 2009/0211763 | A1 * | 8/2009 | Fowler et al. | 166/357 |
| 2009/0211764 | A1 * | 8/2009 | Fielding et al. | 166/357 |

FOREIGN PATENT DOCUMENTS

| | | | |
|---|---|---|---|
| GB | 2 433 759 | A | 7/2007 |
| GB | 2 436 580 | A | 10/2007 |
| WO | 95/15428 | A1 | 6/1995 |
| WO | 02/092965 | A1 | 11/2002 |
| WO | 2005/111372 | A1 | 11/2005 |

* cited by examiner

PUMPING MODULE AND SYSTEM

CROSS REFERENCE TO RELATED APPLICATIONS

This application is a National Stage of International Application No. PCT/GB2008/003438 filed Oct. 10, 2008, claiming priority based on Brazilian Patent Application No. PI 0703726-0, filed Oct. 10, 2007, the contents of all of which are incorporated herein by reference in their entirety.

FIELD OF THE INVENTION

The present invention is related to subsea equipment and pumping systems, more particularly subsea modules located on the sea bed, preferably away from the production well and designed to pump to the surface hydrocarbons with a high associated gas fraction that is produced by one or more subsea production wells.

STATE OF THE ART

Prospecting and production from wells in fields producing hydrocarbons located in increasingly deep water is accompanied by technical difficulties and an increase in the complexity of the operations which have to be performed.

Production of hydrocarbons in the high seas requires that production and injection wells be drilled beneath the sea and that subsea equipment must also be installed. Many of these wells produce hydrocarbons in the form of liquid and gas. The higher the gas fraction, the greater the difficulty encountered in pumping operations, as the presence of gas is prejudicial to pump performance, and sometimes rules out the use of this method of lifting.

A list of possible items of equipment which might be installed in association with subsea production and injection wells and other equipment used, with their acronyms widely known to specialists, is provided immediately below, and these will be used to identify the corresponding equipment mentioned in this document below:

SCT—Subsea Christmas Tree,
PUAB—Pump Adaptor Bases,
PRAB—Production Adaptor Bases,
PM—Pumping Modules,
PETS—Pipeline End Terminal Separator,
PEMS—Pipeline End Manifold Separator,
SPU—Stationary Production Unit,
FPSO—Floating Production Storage Offloading,
ESP—Electrical Submersible Pump,
FLOWLINES—Flowlines,
RISERS—Ascending Flow Lines,
PIG—Line Scraping Equipment,
MANIFOLDS—Production Manifolds.

Other items of equipment which are found alongside those mentioned above which also have to be installed beneath the sea are: subsea separating units (water/oil or gas/liquid), subsea heaters, electrical transformers, and pig launching systems.

An SPU may be built and located on a vessel, a fixed platform or even onshore. When these SPUs are built on vessels' hulls and provide capacity for the processing, storage and discharging of oil they are known as FPSOs.

Normally, production wells are at a distance of some kilometres from the SPU.

In order for the fluids produced from a well to be able to flow towards an SPU at the high flows required to maintain the economic attractiveness of a project, energy, generally in the form of pressure, must be provided to the fluid.

A variety of artificial lifting methods have been used to increase the flows of production fluid. One of these methods uses pumps such as ESPs installed at the bottom of oil-production wells which are generally driven by electric motors.

Under particular conditions the abovementioned pumps may be mounted within modules installed on the sea bed. Known as pumping modules, they may also use other types of pumps, which are not ESPs, such as for example multiphase pumps. The difference lies in the geometry of these two types of pump. Whereas ESPs are designed to be installed within production wells and therefore have to have a long slender geometry, multiphase pumps have a compact geometry because their design envisages that they will be operated and installed on the sea bed away from the production well.

U.S. Pat. No. 4,900,433 by the British Petroleum Company p.l.c. shows an arrangement in which a pump similar to an ESP is installed within a false well, known by specialists as a dummy well, which is created with the aim of accommodating a (liquid/gas) separation and pumping system. The flow of gas-free hydrocarbons is pumped by an ESP as long as the gas flow flows naturally because the back pressure in the gas riser is low.

In this system it is essential that a level control system of a sophisticated type be used, together with control of liquid/gas separation, which in the case in point is carried out by means of a complex system. In addition to this there must be at least two production lines, one for the liquid phase and the other for the gas phase.

In addition to increasing costs, this proposal does not appear to be very efficient, given that as the gas is separated off and removed lifting energy associated with that gas is also removed, and this directly implies the use of high-powered pumps and a very great increase in pressure, especially in the case of deep water.

Brazilian patent application PI 0301255-7 by the present Applicant, and wholly incorporated here by reference, teaches that it is possible to use a pumping module directly connected to subsea equipment, such as for example a wellhead/subsea christmas tree assembly comprising a closed tubular body and a hydraulic connector, in which the connector is connected to an existing terminal in the subsea equipment.

It is also known from U.S. Pat. No. 6,419,458 and U.S. Pat. No. 6,688,392 that it is possible to install a motorised pump unit, similar to an ESP, hydraulically linked to a dummy well, both to produce oil and to inject water or other fluids into the oil reservoir.

From U.S. Pat. No. 6,497,287 and U.S. Pat. No. 6,705,403 it is known that it is possible to install a submersible pump in combination with a pump of the jet type and a gas separator in production wells, making it possible to produce oil with high gas fractions. The disadvantage of this method, mainly in the case of subsea completion (subsea wells), is the great concentration of equipment within the production well, which if a fault should occur requires long-term action on the well (tens of days) in order to make a repair, and this involves removal the column, which requires a very expensive rig.

On the other hand, in U.S. Pat. No. 5,562,161, it is stated that it is possible to install and recover a jet pump driven by injected gas lift within the annulus of the well through an operation involving wire or flexible piping.

On the basis of Brazilian patent applications PI 0400926-6, PI 0404603-0 and PI 0500996-0, all by the Applicant, and incorporated in full herein by reference, it is taught that it is possible to install a PUMO within a lined hole (or a driven hollow pile) in the sea bed.

Nevertheless, because of the substantially vertical geometry of the module, which is tens of metres in length, there is also a greater possibility that a retention space will form and block gas at its top, adversely affecting pump suction.

In Brazilian patent application PI 0403295-0, also by the Applicant, there is a description of an installation comprising at least two or more pumping units on independent modules mounted on structures also known as skids which are supported directly on the sea bed.

There are in the art compact pump models which can be installed on the sea bed, which are alternatives to mounting on skids or incorporation into wellheads.

There are advantages associated with the use of pumps of the ESP type, given that these items of equipment are manufactured on a large scale and are of low cost. Conversely, the slender geometry of this type of pump gives rise to parallel development of solutions for their accommodation, as already mentioned above, and the main restriction on the installation of these pumps outside a production well is their low tolerance to flows of fluid with high fractions in terms of gas.

There is in the present art no system which is equipped with ESPs with a greater tolerance to gas, having a geometry and associated devices which facilitate the work of installation and removal and which can be integrated with other subsea systems.

SUMMARY OF THE INVENTION

This invention relates to a pumping module and subsea pumping system using such a module for the production of hydrocarbons with a high gas fraction, designed to pump hydrocarbons with a high associated gas fraction produced by a subsea production well to the surface.

One aspect of this invention involves a subsea pumping module equipped with conventional pumps for the pumping of substantially liquid phases, of for example the ESP type, in combination with another type of pump which has characteristics having a greater tolerance to gas, such as for example a jet pump or a flow pump.

For this purpose the multiphase flow is divided into two streams: one which is gas-poor and another which is gas-rich. Each of these streams is separately pumped by different equipment, which opens up new possibilities for the application of this equipment and at the same time improves tolerance to gas fractions.

The pumping system according to this invention has a configuration which is interlinked with the pumping module and preferably housed in a lined hole in the sea bed. A gas-liquid separator in the pumping module preferably separates the hydrocarbon production flow into a first flow which is substantially rich in liquid phase and a second flow which is substantially rich in gas phase.

The first flow is delivered to a first pump which is more suitable for the pumping of liquids. The second flow is delivered to a second pump which is more suitable for the pumping of fluids which are rich in the gas phase.

The drive fluid for the second pump can be selected from the flow of fluid originating from the first pump outlet in the pumping module and a fluid compatible with the process and offshore oil production, for example originating from the SPU, and which may be: gas lift, dead oil or water.

The module may be housed within a lined hole or hollow pile, or housed on a skid base supported on the sea bed.

In a first aspect, the invention comprises a subsea module for installation on the sea bed, the subsea module being for pumping to the surface hydrocarbons that have a high associated gas fraction that have been produced by a separate subsea production well, said subsea module comprising:

- a hydrocarbon inlet pipe (2) designed to deliver to the top of the module a flow of oil from said production well having a high associated gas fraction;
- separator equipment (3) connected to the inlet pipe (2) and being for separating the oil into gas and liquid phases which then respectively flow in two separate streams;
- a first pump (4) designed to pump the liquid phase that has been separated by the separator equipment (3);
- a second pump (8) designed to pump the gas phase separated by the separator equipment (3);
- an outlet pipe (9) connected to the outlets of the first and second pumps and being for transporting mixed oil and gas away from the subsea module (PM).

The first pump (4) is preferably a pump of the ESP type.

The second pump (8) is preferably a jet pump.

The second pump (8) is usefully located and constructed so that the outlet flow of the liquid phase stream pumped by the first pump (4) sucks in the gas phase stream.

In another embodiment, the module further comprises:

- a drive fluid pipe (12) for delivering drive fluid provided by the production well;
- wherein said second pump (8) is located and constructed so that the flow of drive fluid in the drive fluid pipe (12) sucks in the gas phase stream.

The separator equipment (3) may be of the cyclone type.

The module is preferably located at a place on the sea bed which may be selected from a lined hole (F) and a hollow pile (E).

The module may have at its top an extension in the form of a gas chamber (11) within which the second pump (8) may be installed.

The module may comprise a check valve to prevent a backflow of gas from the second pump. Any such check valve may be at the top of the module. Aany such check valve may be located at the connection between said gas chamber (11) and the top of the module housing;

The separator equipment (3) is preferably located internally at the top of the module.

The module may comprise a suction pipe (6) for transporting the gas phase separated by the separator equipment (3) located at the top of the module (1) where the gas phase accumulates.

The second pump (8) is preferably located internally at a point along the length of the outlet pipe (9).

The first pump is usually poorly tolerant for pumping a gas phase.

The second pump is usually poorly tolerant for pumping a liquid phase.

The components of the module are preferably housed in a capsule (1), which can have externally at its top an interface (I) for the attachment of an installation and removal tool.

The module may comprise a hydraulic connector (10) connected to the outlet pipe (9). This facilitates connection to the stationary production unit and/or the production well.

The first pump (4) is preferably located below the separator equipment (3).

The first pump is preferably driven by an electric motor (M) powered by an electrical cable (F).

The module may comprise a fluid directing pipe (5), known to specialists by the term "shroud", that encloses the first pump (4) forming a capture region which directs the liquid phase to the inlet (41) of the first pump (4).

Any drive fluid pipe (12) may be connected to the hydraulic connector (10).

The inlet pipe (2) is preferably connected to the hydraulic connector (10).

The invention also provides in another aspect a subsea pumping system for the production of hydrocarbons with a high gas fraction, said system comprising a stationary production unit and a pumping module installed on the sea bed alongside an oil production well (P), comprising:

a first transport pipe (T1) which links the stationary production unit with the annulus of the production well (P) to deliver drive fluid to a well pump (13) installed at the bottom of a production well (P) draining a reservoir (R);

a second transport pipe (T2) connecting the outlet of the well pump (13) to an oil inlet pipe (2) of the pumping module;

a third transport pipe (T3) connecting the outlet pipe (9) of the pumping module (PM) to the stationary production unit.

In a yet further aspect, the invention provides a subsea pumping system for the production of hydrocarbons with a high gas fraction, said system comprising a stationary production unit and a pumping module installed on the sea bed alongside an oil production well (P), comprising:

a first transport pipe (T4) connecting an outlet pipe (9) from the pumping module to the stationary production unit;

a second transport pipe (T5) connecting the pumping module to the annulus of the production well (P) for the supply of drive fluid;

a flow valve (14) located in the second transport pipe (T5) that is used to regulate how much fluid pumped by the pumping module to the first transport pipe (T4) is diverted to the second transport pipe (T5) to act as drive fluid for the well pump (13), a third transport pipe (T6) connecting the outlet of the well pump (13) to an oil inlet pipe (2) of the pumping module.

The pumping module of any one of the embodiments can be mounted on a base (S) supported on the sea bed.

Preferably, when oil is pumped in from the production well (P), the well pump (13) increases the energy of the fluid in the form of pressure and transmits this increase in energy in the form of an increase in suction pressure to the second pump (8) of the subsea module (PM) which as a consequence reduces the fraction of free gas, increasing the flow produced.

In a yet further aspect, the invention provides a method for pumping hydrocarbons to the surface, said method comoprising:

receiving oil from a production well;

seaparating the oil into separate gas and liquid phase streams;

using a first pump to pump the liquid phase;

using a second pump to pump the gas phase;

mixing the gas and liquid phases and transporting the mixture to the surface.

In this method, the second pump is preferably a jet pump and the step of using the second pump preferably comprises sucking the gas phase into the liquid phase using the flow of the liquid phase provided by the first pump.

The method is preferably carried out in a dummy well alongside the production well, with the oil being provided to the top of the dummy well such that the gas and liquid phases separate as the oil flows downwardly.

In another embodiment, the invention comprises a subsea module installed on the sea bed, preferably away from a production well and intended to pump hydrocarbons having a high associated gas fraction produced by a subsea production well to the surface, characterised in that it comprises:

a capsule (1) intended to house the components of the pumping module (PM), which has externally at its top an interface (I) for the attachment of an installation and removal tool, an oil inlet pipe (2) designed to deliver a flow of oil from a production well into the pumping module (PM), separator equipment (3) located internally at the top of the capsule (1) and connected to the oil inlet pipe (2), intended to separate the flow of oil originating from a production well into two separate phases, such as gas and liquid, which then flow in two separate streams, a first pump (4) located below the separator equipment (3) close to the bottom of the capsule (1) has characteristics of low tolerance to the gas phase and is designed to pump liquid phase separated by the separator equipment (3) and is driven by an electric motor (M) powered by an electrical cable (F), a fluid directing pipe (5), known to specialists by the term "shroud", encloses the first pump (4) forming a capture region which directs the liquid phase to the inlet (41) of the first pump (4), a suction pipe (6) which is used to transport gas separated by the separator equipment (3) is connected to the top of the capsule (1) where the gas phase accumulates and has a check valve (7) located at a point along its length which is used to prevent the backflow of gas, a second pump (8) which is poorly tolerant for liquid phase is connected to the suction pipe (6) and is intended to pump gas phase separated by the separator equipment (3), an outlet pipe (9) designed to transport oil and gas pumped away from the subsea module (PM) via a hydraulic connector (10) is connected to the outlet of first pump (4) and has a second pump (8) located internally at a point along its length.

Preferably, in this module the first pump (4) is a pump of the ESP type and the second pump (8) is a jet pump.

Preferably, in this module the separator equipment (3) is of the cyclone type.

Preferably, in this module the second pump (8) is located within the outlet pipe (9) so that the outlet flow of liquid phase pumped by the first pump (4) sucks in the gas phase captured by the suction pipe (6) of this second pump (8).

In another embodiment, a module is provided that comprises all the elements in the preceding embodiment, except:

a drive fluid pipe (12) connected to the hydraulic connector (10) is responsible for delivering the drive fluid provided by the SPU, the second flow pump (8) is driven by the flow of drive fluid delivered by the drive fluid pipe (12), the capsule (1) has at its top an extension in the form of a gas chamber (11) within which there is installed second pump (8) and at the connection between gas chamber (11) and the top of the housing there is a check valve (7) which is used to prevent the backflow of gas.

Preferably, the module is located at a place on the sea bed which may be selected from a lined hole (F) and a hollow pile (E).

Another embodiment of the invention provides a subsea pumping system for the production of hydrocarbons with a high gas fraction comprising a pumping module (PM) installed on the sea bed alongside an oil production well, characterised in that it comprises:

a first transport pipe (T1) which links the SPU with the annulus of the production well (P) to deliver drive fluid to a well pump (13) installed at the bottom of a production well (P) draining a reservoir (R), a second transport pipe (T2) connecting the outlet of the well pump (13) via a hydraulic connector (10) to the oil inlet pipe (2) of the pumping module (PM), a third transport pipe (T3) connecting the outlet pipe (9) from the pumping module (PM) to the SPU.

Another embodiment of the invention provides a subsea pumping system for the production of hydrocarbons with a high gas fraction which comprises a pumping module (PM) installed on the sea bed alongside an oil production well, characterised in that it comprises:

a fourth transport pipe (T4) connecting the outlet pipe (9) from the pumping module (PM) to the SPU, a fifth transport pipe (T5) connecting the pumping module (PM) via the annular space of the production well (P) to the well pump (13) for the supply of drive fluid, a flow valve (14) located in the fifth transport pipe (T5) is used to regulate how much fluid pumped by the pumping module (PM) to the fourth transport pipe (T4) is diverted to a fifth transport pipe (T5) to act as drive fluid for the well pump (13), a sixth transport pipe (T6) connecting the outlet from the well pump (13) to the oil inlet pipe (2) of the pumping module (PM).

The subsea pumping system may comprise one of the embodiments already described for the pumping module (PM) mounted on a base (S) supported on the sea bed.

Preferably, in these embodiments, when oil is pumped in from the production well (P) the well pump (13) increases the energy of the fluid in the form of pressure and transmits this increase in energy in the form of an increase in suction pressure to the second pump (8) of the subsea module (PM) which as a consequence reduces the fraction of free gas, increasing the flow produced.

BRIEF DESCRIPTION OF THE DRAWINGS

The characteristics of the pumping module and system for the subsea pumping of hydrocarbon production with a high associated gas fraction will be better understood from the following detailed description, purely by way of example, associated with the drawings mentioned below, which form an integral part of this description and in which.

DETAILED DESCRIPTION

A detailed description of the pumping module, system for the subsea pumping of hydrocarbon production with a high associated gas fraction and corresponding methods will be provided on the basis of the identifications of the components based on the figures described above.

This invention relates in one aspect to a module and subsea pumping system for the production of hydrocarbons with a high gas fraction which is designed to pump hydrocarbons with a high associated gas fraction produced by a subsea production well to the surface.

One aim of this invention is achieved through the design of a pumping module (PM) which is interlinked with pumping equipment already present in the production well.

Figure 1:
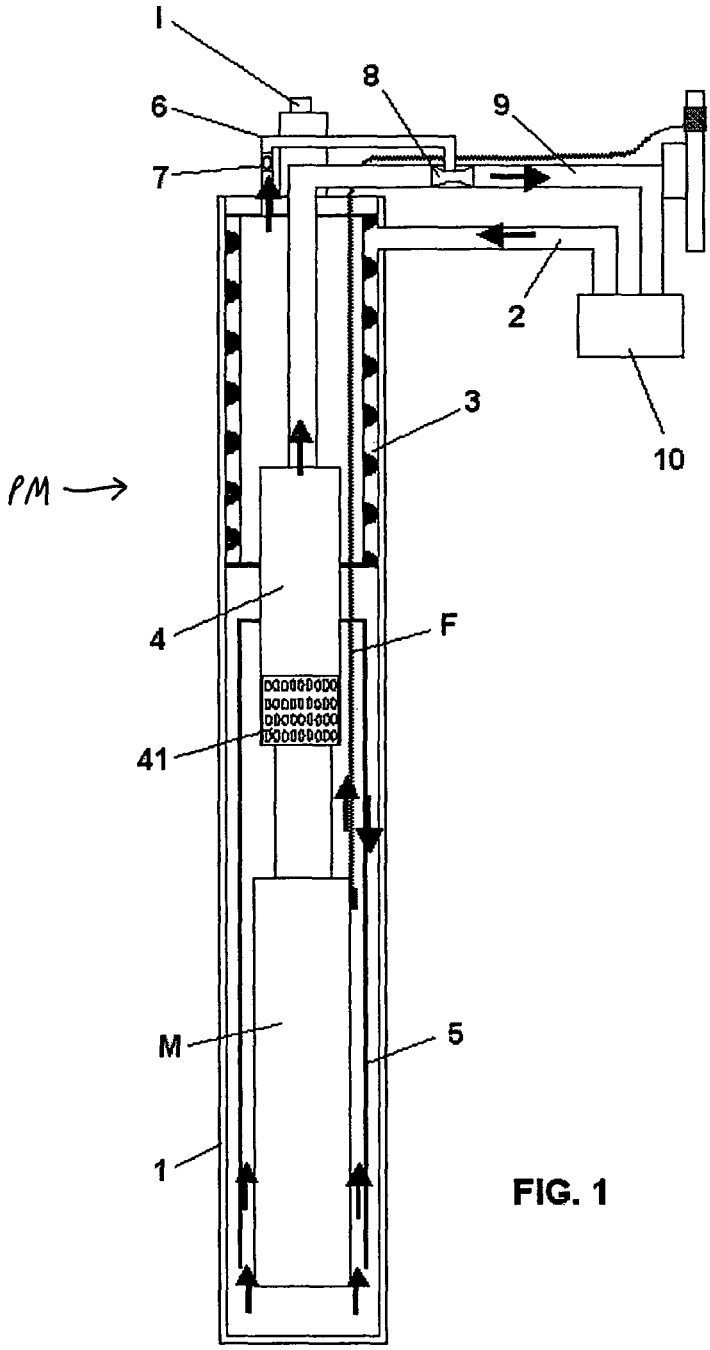
FIG. 1 shows a diagrammatical representation of a first embodiment of a pumping module according to this invention.

FIG. 1 shows a possible embodiment of the pumping module which may comprise:

a capsule (1) intended to house the components of the pumping module (PM), having externally at its top an interface (I) for the attachment of an installation and removal tool, an oil inlet pipe (2) designed to deliver a flow of oil from a production well into the pumping module (PM), separator equipment (3) located internally at the top of the capsule (1) and connected to the oil inlet pipe (2), intended to separate the flow of oil originating from a production well into two separate phases, such as gas and liquid, which then flow in two separate streams, a first pump (4) located below the separator equipment (3) close to the bottom of the capsule (1) has characteristics of low tolerance to the gas phase and is designed to pump liquid phase separated by the separator equipment (3) and is driven by an electric motor (M) powered by an electrical cable (F), a fluid directing pipe (5), known by specialists by the term "shroud", encloses the first pump (4) forming a capture region which directs the liquid phase to the inlet (41) of first pump (4), a suction pipe (6) which is used to transport gas separated by separator equipment (3) is connected to the top of capsule (1) where the gas phase accumulates and has a check valve (7) located at a point along its length which is used to prevent the backflow of gas, a second pump (8) which is poorly tolerant for liquid phase is connected to the suction pipe (6) and is intended to pump gas phase separated by separator equipment (3), an outlet pipe (9) intended to transport oil and gas pumped away from the subsea module (PM) via a hydraulic connector (10) is connected to the outlet of first pump (4) and has a second pump (8) located internally at a point along its length.

The first pump (4) is preferably a pump of the ESP type. The second pump (8) may be any one useful for pumping a gas phase and is preferably selected from a jet pump and a flow pump.

In this embodiment the second pump (8) is a jet pump.

The separator equipment (3) is preferably of the cyclone type. This tuype of separatot cauises the fluid to undergo cicular motion, which helps to release the gas from the liquid. Upon separation, the gas usually moves upwards and the liquid usually flows downwards.

The second pump (8) is in this embodiment located within an outlet pipe (9) so that the outlet flow of the liquid phase pumped by first pump (4) sucks in the gas phase captured by the suction pipe (6) of this second pump (8).

Figure 2:
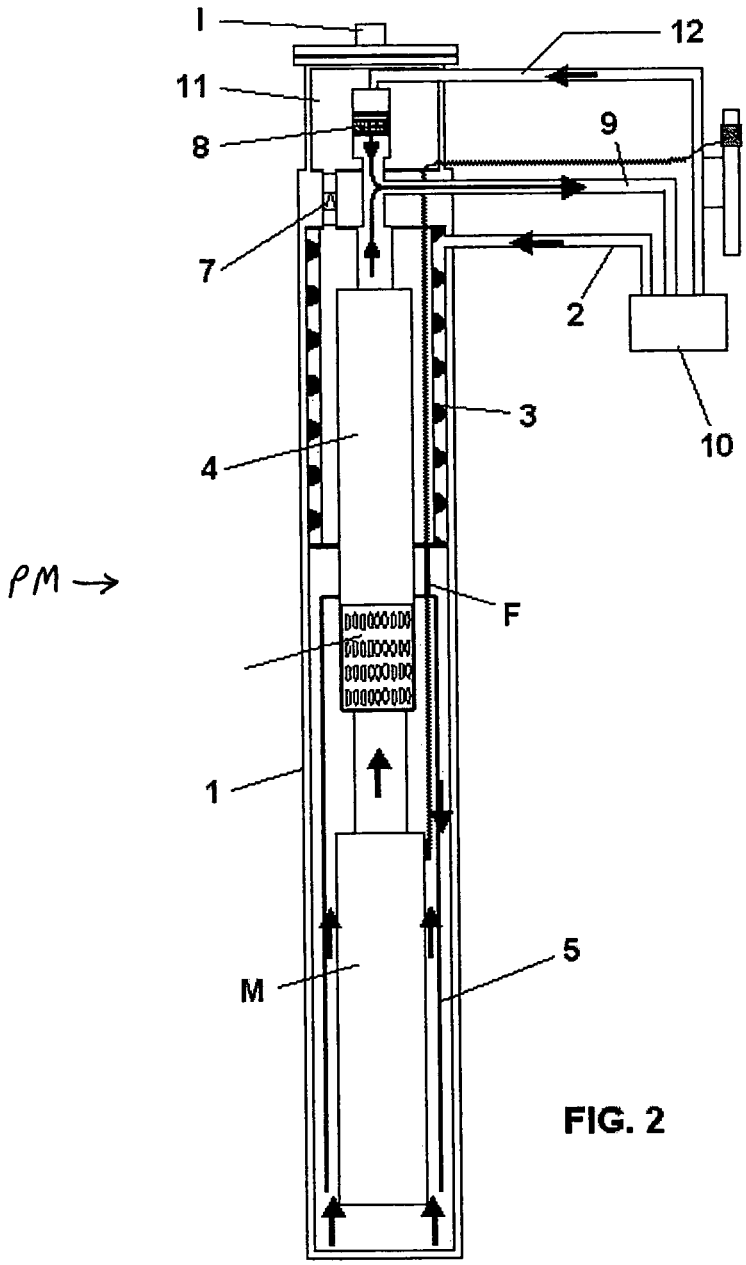
FIG. 2 shows a diagrammatical view of a second embodiment of a pumping module according to this invention.

FIG. 2 shows a second possible embodiment for the pumping module according to this invention, comprising the elements in the previous embodiment, except that:

a drive fluid pipe (12) connected to hydraulic connector (10) is responsible for delivering the drive fluid provided by the SPU, the second flow pump (8) is driven by the flow of drive fluid delivered by drive fluid pipe (12), In this embodiment, the capsule (1) preferably has at its top an extension in the form of a gas chamber (11) within which the second pump (8) can be installed. Preferably, at the connection between gas chamber (11) and the top of the housing, there is a check valve (7) which is used to prevent the backflow of gas.

The flow of drive fluid originating from the SPU to drive the second pump (8) can be selected from gas lift, dead oil, less viscous oil, water or another fluid compatible with the production process.

The pumping module (PM) is preferably housed at a locality on the sea bed which may be selected from a lined hole (F) and a hollow pile (E). Alternatively, the module may be mounted on a skid.

Figure 3:
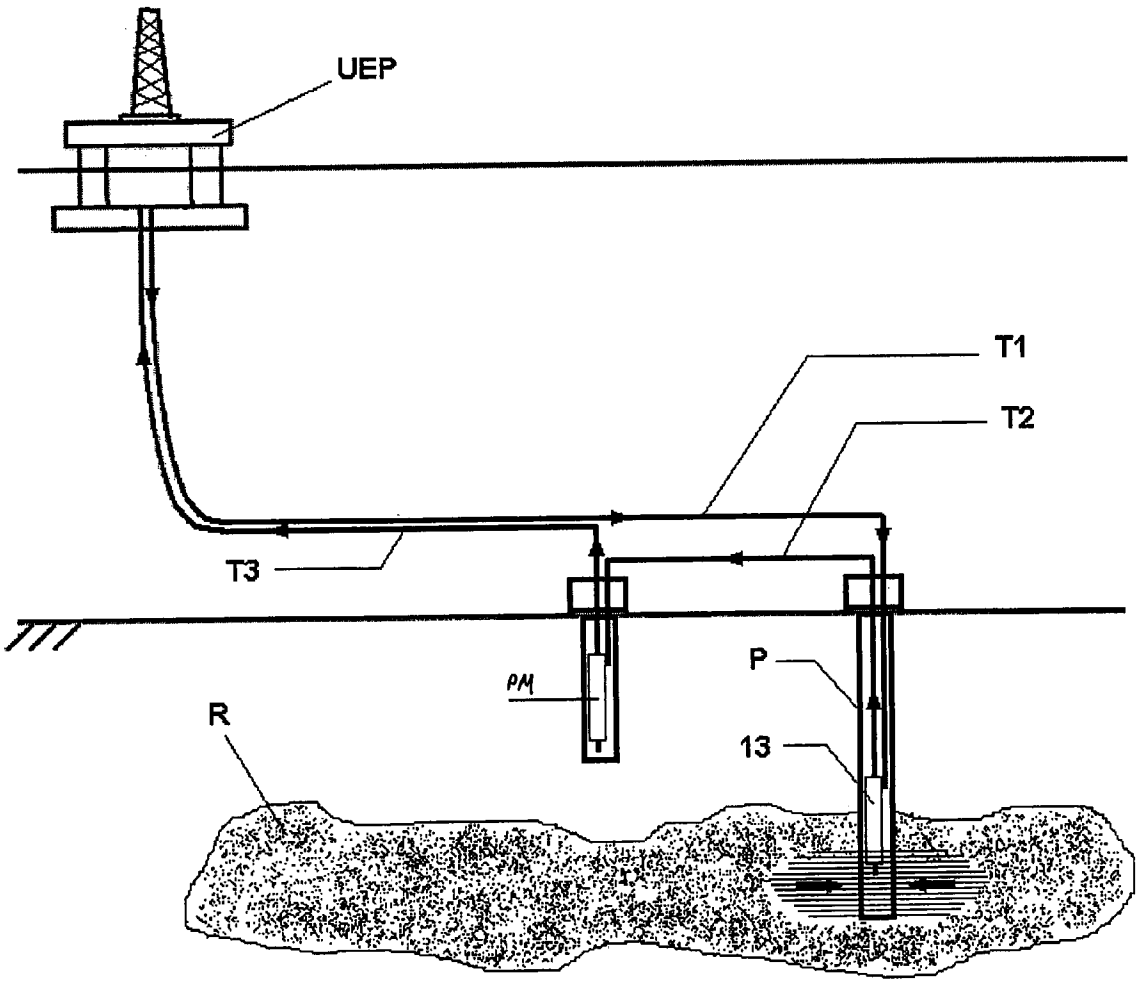
FIG. 3 shows a diagrammatical view of a first embodiment of a pumping system according to this invention.

A subsea pumping system for the production of hydrocarbons with a high gas fraction, another aspect of this invention, can be seen in the first embodiment in FIG. 3. It may comprise any of the embodiments already mentioned for the pumping module (PM) installed on the sea bed, preferably alongside an oil production well.

It will be noted that the illustrated system comprises:

a first transport pipe (T1) which links the SPU with the annulus of the production well (P) to deliver drive fluid to a well pump (13) installed at the bottom of a production well (P) draining a reservoir (R), a second transport pipe (T2) connecting the outlet of well pump (13) via a hydraulic connector (10) to the oil inlet pipe (2) of the pumping module (PM), a third transport pipe (T3) connecting outlet pipe (9) from the pumping module (PM) to the SPU.

Figure 4:
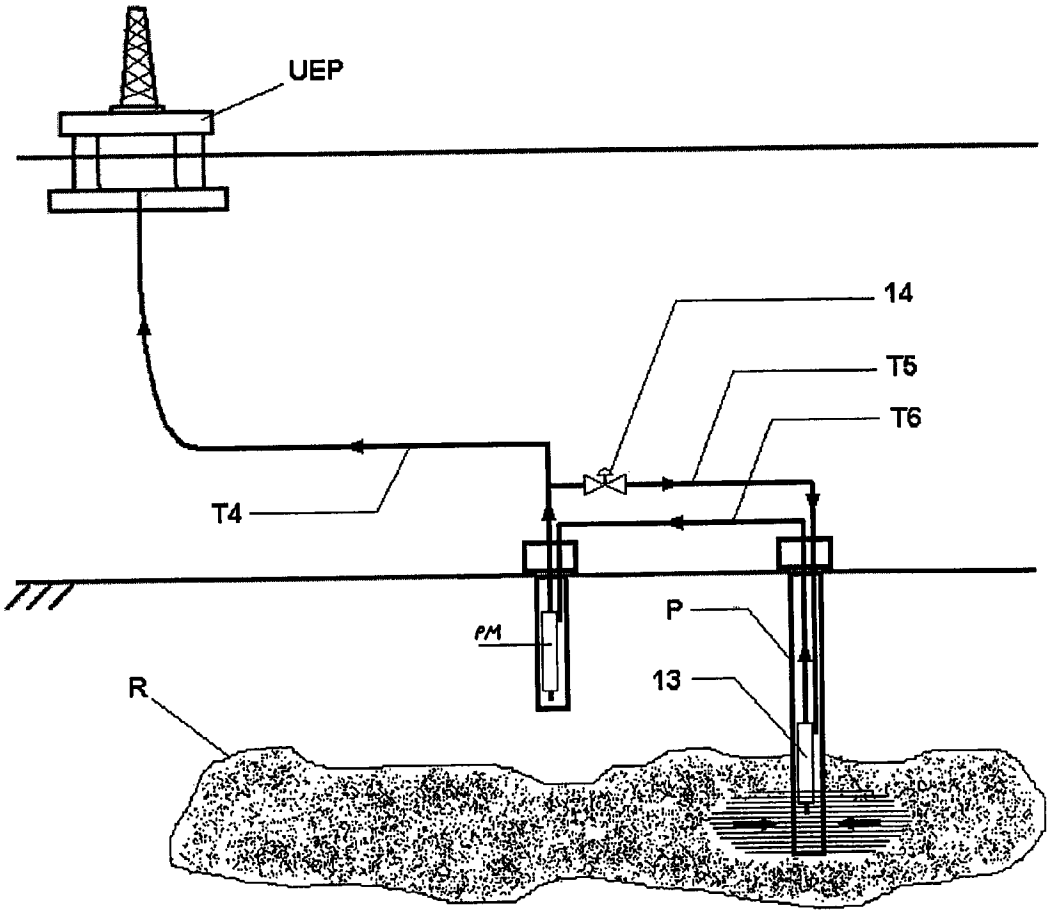
FIG. 4 shows a diagrammatical view of a second embodiment of a pumping system according to this invention.

The subsea pumping system for the production of hydrocarbons having a high gas fraction according to this invention can be seen in a second embodiment in FIG. 4 which again may comprise any of the embodiments already mentioned for the pumping module (PM) installed on the sea bed, again preferably alongside an oil production well.

It will be noted that this system comprises:

a first transport pipe (T4) connecting outlet pipe (9) from the pumping module (PM) to the SPU, a second transport pipe (T5) connecting the pumping module (PM) via the annular space of the production well (P) to the well pump (13) for the supply of drive fluid, a flow valve (14) located in the second transport pipe (T5) used to regulate the quantity of fluid pumped by the pumping module (PM) to the first transport pipe (T4) is diverted to a second transport pipe (T5) to act as drive fluid for well pump (13), a third transport pipe (T6) connecting the outlet from well pump (13) to the oil inlet pipe (2) of the pumping module (PM).

The pumping system according to this invention may be embodied in a third way which may comprise any of the embodiments already mentioned for the pumping module (PM) fixed on a base (S) known to specialists by the term skid supported on the sea bed, which is not shown in any Figure in this description.

When oil is pumped in from the production well (P), the well pump (13) increases the energy of the fluid in the form of pressure and transmits this increase in energy in the form of an increase in suction pressure to the second pump (8) of the subsea module (PM) which as a consequence reduces the fraction of free gas, increasing the flow produced.

The description of the pumping module and system for the subsea pumping of hydrocarbons to which this invention relates provided hitherto must be regarded only as possible embodiments and means, and any particular features included in them should be understood as only things which have been described in order to aid understanding. This being the case, they cannot in any way be regarded as restricting the invention, which is only restricted by the scope of the following claims.

The invention claimed is:

1. A subsea module for installation on the sea bed, the subsea module being for pumping to the surface hydrocarbons that have a high associated gas fraction that have been produced by a separate subsea production well, said subsea module comprising:

a hydrocarbon inlet pipe (2) designed to deliver to the top of the module a flow of oil from said production well having a high associated gas fraction;

separator equipment (3) connected to the inlet pipe (2) and being for separating the oil into gas and liquid phases which then respectively flow in two separate streams;

a first pump (4) designed to pump the liquid phase that has been separated by the separator equipment (3);

a second pump (8) designed to pump the gas phase separated by the separator equipment (3);

an outlet pipe (9) connected to the outlets of the first and second pumps and being for transporting mixed oil and gas away from the subsea module (PM) wherein the liquid phase and the gas phase flow separately to the outlet pipe.

2. A module according to claim 1, wherein the first pump (4) is a pump of the ESP type.

3. A module according to claim 1, wherein the second pump (8) is a jet pump.

4. A module according to claim 3, wherein said second pump (8) is located and constructed so that the outlet flow of the liquid phase stream pumped by the first pump (4) sucks in the gas phase stream.

5. A module according to claim 1, further comprising:

a drive fluid pipe (12) for delivering drive fluid provided by the production well;

wherein said second pump (8) is located and constructed so that the flow of drive fluid in the drive fluid pipe (12) sucks in the gas phase stream.

6. A module according to claim 1, wherein the separator equipment (3) is of the cyclone type.

7. A module according to claim 1, said module being located at a place on the sea bed which may be selected from a lined hole and a hollow pile.

8. A module according to claim 1, further comprising any one or more of the following optional features (a)-(p):

(a) the module has at its top an extension in the form of a gas chamber (11) within which the second pump (8) may be installed;

(b) the module comprises a check valve to prevent a backflow of gas from the second pump;

(c) any such check valve is at the top of the module;

(d) any such check valve may be located at the connection between said gas chamber (11) and the top of the module housing;

(e) the separator equipment (3) is located internally at the top of the module;

(f) the module comprises a suction pipe (6) for transporting the gas phase separated by the separator equipment (3) located at the top of the module (1) where the gas phase accumulates;

(g) the second pump (8) is located internally at a point along the length of the outlet pipe (9);

(h) the first pump is poorly tolerant for pumping a gas phase;

(i) the second pump is poorly tolerant for pumping a liquid phase;

(j) the components of the module are housed in a capsule (1), which has externally at its top an interface (I) for the attachment of an installation and removal tool;

(k) the module comprises a hydraulic connector (10) connected to the outlet pipe (9);

(l) the first pump (4) is located below the separator equipment (3);

(m) the first pump is driven by an electric motor (M) powered by an electrical cable (F);

(n) the module comprises a fluid directing pipe (5), known to specialists by the term "shroud", that encloses the first pump (4) forming a capture region which directs the liquid phase to the inlet (41) of the first pump (4);

(o) any drive fluid pipe (12) is connected to the hydraulic connector (10); and (p) the inlet pipe (2) is connected to the hydraulic connector (10).

9. A module according to claim 1, wherein the outlet of the first pump intersects with the outlet of the second pump.

10. A module according to claim 1, further comprising a transport pipe connected to the separator equipment for supplying the gas phase separated by the separator equipment to the second pump, wherein the transport pipe includes a check valve.

11. A method for pumping hydrocarbons to the surface, said method comprising:

receiving oil from a production well subsea;

separating the oil into separate gas and liquid phase streams;

using a first pump to pump the liquid phase to an outlet pipe;

using a second pump to pump the gas phase to the outlet pipe;

mixing the gas and liquid phases in the outlet pipe and transporting the mixture to the surface in the outlet pipe, wherein the liquid phase and the gas phase flow separately to the outlet pipe.

12. The method of claim 11, wherein the second pump is a jet pump and wherein the step of using the second pump comprises sucking the gas phase into the liquid phase using the flow of the liquid phase provided by the first pump.

13. The method of claim 11, wherein the method is carried out in a dummy well alongside the production well, with the oil being provided to the top of the dummy well such that the gas and liquid phases separate as the oil flows downwardly.

14. The method of claim 11, wherein the outlet of the first pump intersects with the outlet of the second pump.

15. The method of claim 11, wherein the gas phase is supplied to the second pump by a transport pipe, wherein the transport pipe includes a check valve.

* * * * *